US007622023B2

(12) United States Patent
Lövgren

(10) Patent No.: US 7,622,023 B2
(45) Date of Patent: Nov. 24, 2009

(54) TWIN-WIRE PRESS

(75) Inventor: Hans Lövgren, Sundsvall (SE)

(73) Assignee: Metso Paper, Inc. (FI)

( * ) Notice: Subject to any disclaimer, the term of this patent is extended or adjusted under 35 U.S.C. 154(b) by 357 days.

(21) Appl. No.: 10/593,198

(22) PCT Filed: Mar. 17, 2005

(86) PCT No.: PCT/SE2005/000388

§ 371 (c)(1),
(2), (4) Date: Sep. 18, 2006

(87) PCT Pub. No.: WO2005/090673

PCT Pub. Date: Sep. 29, 2005

(65) Prior Publication Data

US 2007/0187058 A1 Aug. 16, 2007

(30) Foreign Application Priority Data

Mar. 22, 2004 (SE) ..... 0400717

(51) Int. Cl.

| | |
|---|---|
| ***D21F 1/24*** | (2006.01) |
| ***D21F 3/04*** | (2006.01) |
| ***D21C 9/18*** | (2006.01) |
| ***B30B 9/24*** | (2006.01) |
| ***B30B 5/06*** | (2006.01) |

(52) U.S. Cl. ..... 162/273; 162/303; 162/305; 162/56; 100/118

(58) Field of Classification Search ..... 162/203, 162/300, 301, 303, 304, 305, 272, 273, 56; 100/37, 41, 118–120

See application file for complete search history.

(56) References Cited

U.S. PATENT DOCUMENTS

| | | | | |
|---|---|---|---|---|
| 3,556,939 | A | 1/1971 | Stenberg | |
| 3,929,065 | A * | 12/1975 | Csordas et al. | 100/90 |
| 3,994,774 | A | 11/1976 | Halme et al. | |
| 4,472,244 | A | 9/1984 | Haltsonen | |
| 5,783,045 | A * | 7/1998 | Santos et al. | 162/301 |
| 6,003,684 | A * | 12/1999 | Eickhoff et al. | 210/401 |
| 6,214,167 | B1 | 4/2001 | Halmschlager | |
| 6,338,773 | B1 * | 1/2002 | Sbaschnigg et al. | 162/300 |
| 7,051,882 | B2 * | 5/2006 | Odmark et al. | 210/401 |

FOREIGN PATENT DOCUMENTS

| | | | |
|---|---|---|---|
| AT | 402 517 B | | 6/1997 |
| GB | 1199036 | * | 7/1970 |

* cited by examiner

*Primary Examiner*—Eric Hug
(74) *Attorney, Agent, or Firm*—Lerner, David, Littenberg, Krumholz & Mentlik, LLP

(57) ABSTRACT

Twin-wire presses for dewatering fiber suspensions are disclosed including upper and lower rolls and endless upper and lower wires running around the rolls, a pair of dewatering tables supporting the upper and lower wires and forming a dewatering space between them for initial pressing and dewatering of the fiber suspension, to form a fiber web between the wires, a roll engagement downstream of the watering tables, a final dewatering in a press frame, a press and lift arrangement for vertically adjusting the first dewatering table and a link system joined to the press frame and to an upper section of the first dewatering table which is movable from and against the second dewatering table by means of the press and lift arrangement thereby.

9 Claims, 1 Drawing Sheet

TWIN-WIRE PRESS

FIELD OF THE INVENTION

The present invention relates to a twin-wire press for dewatering of a fiber suspension.

BACKGROUND OF THE INVENTION

Twin-wire presses for dewatering of a fiber suspension and forming of a continuous web thereof are previously known. Dewatering of the pulp is usually done from an inlet pulp concentration of 3-8 percentages by weight to an outlet pulp concentration of 30-50 percentages by weight. According to the state of the art, such twin-wire presses comprises lower rolls, an endless lower wire running in a path around the lower rolls, upper rolls, and an endless upper wire running in a path around the upper rolls. The two wires co-operate with each other along sections of said paths that run substantially in parallel with each other for dewatering of the fiber suspension between the wires during displacement thereof. An inlet box provides for supply of the fiber suspension to a wedge-shaped dewatering space between the wires. The twin-wire press further comprises two dewatering tables supporting the respective wire in said sections of the path and forming the wedge-shaped dewatering space between the wires for initially pressing and dewatering the fiber suspension, whereby a web is formed between the wires, and a roll arrangement situated after the dewatering tables in said sections of the paths, as seen in the direction of movement of the wires, for finally pressing and dewatering the web between the wires, so that the web will get a desired dryness.

It is often necessary in a simple way and as quickly as possible at maintenance, exchange of wire and cleaning of the twin-wire press, without prolonged stoppage of production, to be able to reach the dewatering apace between the upper and lower dewatering tables. An apparatus for lifting of the upper table in twin-wire presses is known, which is a lifting apparatus integrated in the press that is arranged to lift up the side of the upper dewatering table, hereinafter denoted the front edge, that is adjacent the roll arrangement. A rear edge of the dewatering table remains in the original position. The known lifting apparatus only permits a limited lifting of the upper dewatering table, and only of its front edge, which means that the accessibility to those areas of the dewatering space that are situated in vicinity of the rear edge of the upper and lower dewatering tables still are restricted, whereby maintenance, exchange of wire and cleaning is time-consuming and circumstantial.

One object of the present invention is to achieve an easier, more effective and improved twin-wire press where the whole dewatering space is easily accessible for maintenance, exchange of wire and cleaning if required, and where at least those drawbacks that are associated with previously known state of the art can be partially eliminated. Another object is to provide a twin-wire press where maintenance, exchange of wire and cleaning of the press can be carried out cost efficiently and in a work saving way.

SUMMARY OF THE INVENTION

In accordance with the present invention, these and other objects are achieved with the twin-wire press for dewatering of a fiber suspension. The twin-wire press comprises lower rolls, an endless lower wire that runs in a path around the lower rolls, upper rolls and an endless upper wire that runs in a path around the upper rolls. Further the twin-wire press comprises first and a second dewatering table, respectively, which supports the respective upper and lower wires, which dewatering tables forms a wedge-shaped dewatering space between the wires in the longitudinal direction of the twin-wire press for initial pressing and dewatering of the fiber suspension. In that respect a fiber web can be formed between the wires, and a roll arrangement is provided and positioned after the dewatering tables, as seen in the direction of movement of the wires, for finally pressing and dewatering of the fiber web between the wires. The roll arrangement is provided in a press frame. A press and lift arrangement is arranged to the first dewatering table for vertically adjusting the first dewatering table. The twin-wire press is characterised in that a link system is arranged in one end with a joint at the press frame and in a second end arranged with a joint at an upper section of the first dewatering table. In that respect the first dewatering table can be moved along its whole longitudinal extension in direction from and against the second dewatering table by movement by means of the press and lift arrangement.

The present invention makes it possible that work with maintenance, exchange of wire and cleaning of the twinwire press can be carried out efficiently whereby the operation of the press only need to be interrupted for a short period than what has been required previously. Hence, time and cost savings are obtained thanks to that the whole first dewatering table can be lifted or lowered along its whole longitudinal extension, in the twin-wire press according to the present invention, such that desired accessibility to the dewatering space can be provided between the whole longitudinal extension of the first dewatering table and the whole longitudinal extension of the second dewatering table.

According to a preferred embodiment of the present invention, an end section of the press and lift arrangement is fixed to the press frame and a second end section of the press and lift arrangement is arranged to the first dewatering table. In that respect the press and lift arrangement is suitably arranged in vicinity of a front edge of the first dewatering table. Preferably the press and lift arrangement is arranged at a projecting section of the press frame, at a position on distance from the dewatering space connection to an upper section of the first dewatering table. The press and lift arrangement is preferably a hydraulic cylinder. The link system may suitably comprise a link arm that in one end is pivotally arranged in the first dewatering table, and in a second end is pivotally arranged in said joint at the press frame. Preferably the first dewatering table is composed of an upper dewatering table and the second dewatering table of a lower dewatering table.

BRIEF DESCRIPTION OF THE DRAWINGS

The present invention will now be described in more detail by embodiments, with reference to accompanying drawings, without restricted interpretation of the invention thereof, where FIG. 1 schematically shows in an overview a longitudinal cross-section through a twin-wire press according to an embodiment of the present invention.

DETAILED DESCRIPTION

Figure 1:
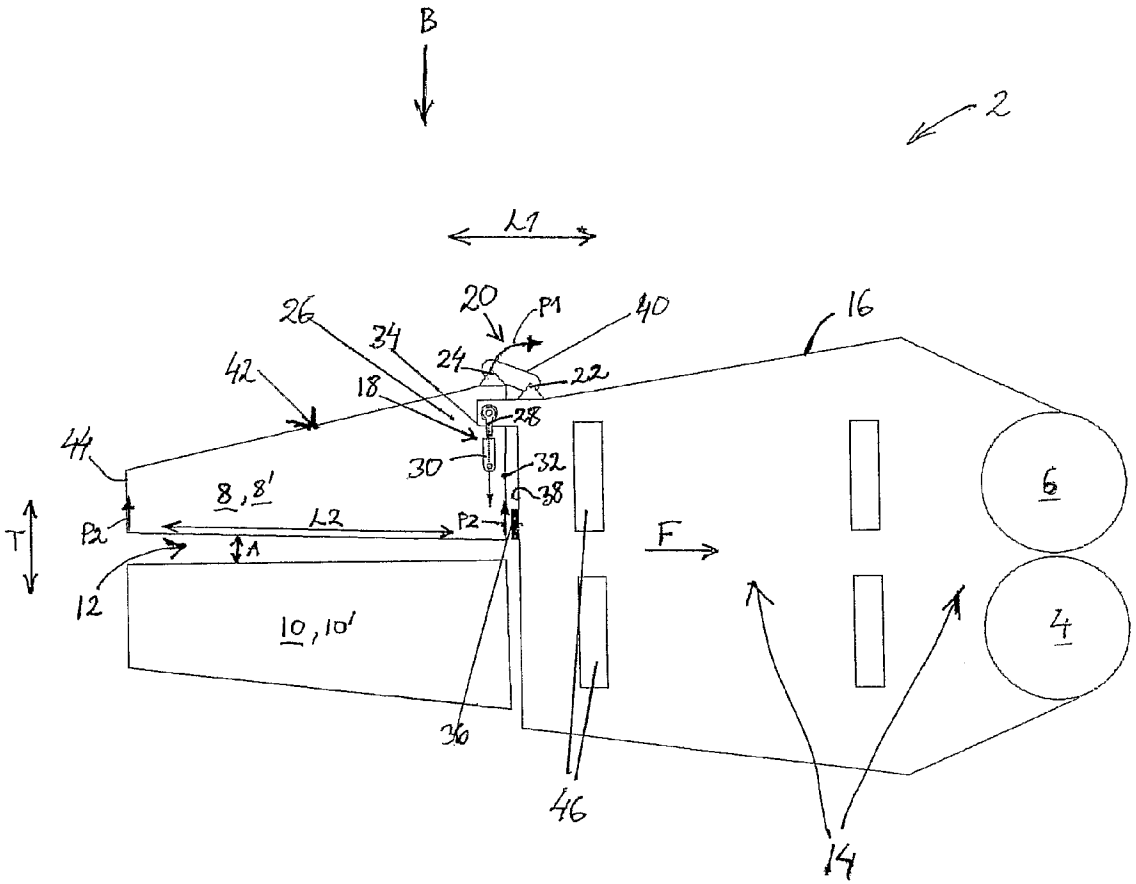

A twin-wire press 2 for dewatering of a fiber suspension is shown in FIG. 1. The twin-wire press comprises lower rolls 4 (in the FIGURE is only shown one of the lower rolls), an endless lower wire (not shown) that runs in a path around the lower rolls, upper rolls 6 (in the FIGURE is only shown one of the upper rolls) and an endless upper wire (not shown) that runs in a path around the upper rolls. Further the twin-wire press 2 comprises a first dewatering table, here shown as an upper dewatering table 8, respectively a second dewatering table, here shown as a lower dewatering table 10, which supports the respective upper and lower wires, which dewatering tables 8, 10 forms a wedge-shaped dewatering space 12 between the wires in the longitudinal direction L1 of the twin-wire press for initial pressing and dewatering of the fiber suspension, whereby a fiber web can be formed between the wires. A roll arrangement 14 (only pair of rolls 4, 6 is shown in FIG. 1) is arranged after the dewatering tables 8, 10, seen in the direction of movement (F) of the wires, for final pressing and dewatering of the fiber web between the wires. The roll arrangement 14 is provided in a press frame 16. A press and lift arrangement 18 is arranged to the upper dewatering table 8 for vertically adjusting the upper dewatering table. A link system 20 is arranged in one end with a joint 22 at the press frame 16 and in another end arranged with a joint 24 at an upper section 26 of the upper dewatering table 8. The upper dewatering table 8 can be moved along its whole longitudinal extension L2 in a vertical direction T from and against the longitudinal direction L1 of the lower dewatering table 10 by movement by means of the press and lift arrangement 18. The twin-wire press may preferably comprise a corresponding link system and a press and lift arrangement as described herein, according to the present invention, on each side of the twin-wire press (in FIG. 1 is only shown one side of the twin-wire press).

By reference to FIG. 1 is described that the first dewatering table is an upper dewatering table 8 and the second dewatering table is a lower dewatering table 10. However, the situation can be the opposite according to an alternative embodiment. If the whole twin-wire press as shown in FIG. 1 is viewed upside-down (from a direction B according to arrow in FIG. 1), said first dewatering table is composed of a lower dewatering table 8' and said second dewatering table is composed of a upper dewatering table 10'. Thus, according to this embodiment is the press and lift arrangement 18 and the link system 20 arranged to the lower dewatering table 8'. Hence, a vertical adjustment is instead achieved of the lower dewatering table 8'.

Different kinds of press and lift arrangements 18 that can be used in the present invention are possible. The press and lift arrangement can, for example, as shown in FIG. 1, preferably be a hydraulic cylinder, that has a piston 28 with, a certain cylinder stroke arranged in a liquid filled, such as oil filled, cylinder 30.

An end section of the press and lift arrangement 18 can suitably be fixed to the press frame 16 according to the embodiment shown in FIG. 1, such as an outer end of the piston 28 of said preferred hydraulic cylinder. A corresponding second end section of the press and lift arrangement, such as the outer end section of the cylinder portion 30 of the preferred hydraulic cylinder, can be arranged to the upper dewatering table 8. As is evident from FIG. 1, the press and lift arrangement 18 can be arranged in the vicinity of a front edge 32 of the upper table 8. One end of the press and lift arrangement may suitably be connected to a projecting section 34 of the press frame, situated in connection to an upper section 26 of the upper dewatering table 8 on distance from the dewatering space 12. The other end of the press and lift arrangement is connected to the upper dewatering table, suitably in a position in vicinity of the front edge of the dewatering table. Further, the press frame may comprise a stop member 36 arranged on a surface 38 of the press frame in the space between the press frame and the front edge of the upper table, which stop member 36 prevents movement of the upper dewatering table 8 in the longitudinal direction L1 of the twin-wire press at vertical adjustment of the upper dewatering table. The stop member 36, that is suitably of a durable material having low friction, can be shaped as a projecting section with a supporting surface directed against the front edge 32 of the upper dewatering table. At vertical adjustment in direction T of the upper dewatering table 8 the front edge 32 of the upper dewatering table can slide along the supporting surface of the stop member 36.

Further, the link system 20 according to the present invention can comprise a link arm 40 that in one end is pivotally arranged in said joint 24 at the upper dewatering table 8, suitably to the upper side 42 of the upper dewatering table 8 in immediate connection to the front edge 32 of the upper dewatering table, and in a second end pivotally arranged in said joint 22 at the press frame 16, such as is shown in FIG. 1.

When the press and lift arrangement 18 is actuated, for example at a reduced cylinder stroke when using a preferred hydraulic cylinder, for a desired raise of the upper dewatering table 8, the dewatering table 8 is raised along its whole longitudinal extension L2 by a simultaneous turning of the link arm 20 around joints. 24 and 22 of the link system 20 (see arrow PI in FIGURE). A rear edge 44 of the upper dewatering table 8 is raised substantially equally as much as the front edge 32 (see arrow P2 in FIGURE). The front edge 32 slides during the vertical movement of the dewatering table against the stop member 36 that simultaneous prevents that no substantial motion of the dewatering table 8 along the longitudinal direction L1 of the twin-wire press occurs. An increased distance A between the lower and upper dewatering tables may accordingly be achieved, along the whole longitudinal extension L2 of the dewatering space, in order to facilitate desired accessibility for maintenance, exchange of wire and cleaning when necessary.

FIG. 1 also shows schematically the position for an apparatus 46 for elevation of the upper table in twin-wire presses according to the prior art, which is an integrated lifting device in the press that is arranged to raise up the front side of the upper dewatering table, that is faced to the roll arrangement. The known lifting device only permits a limited elevation of the front side of the upper dewatering table.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A twin-wire press for dewatering a fiber suspension, comprising a plurality of lower rolls, an endless lower wire that runs around said plurality of lower rolls, a plurality of upper rolls, an endless upper wire that runs around said plurality of upper rolls, thereby defining a longitudinal direction for said press, a first dewatering table and a second dewatering table supporting said endless upper and lower wires, respectively, said first and second dewatering tables being present at substantially the same longitudinal location of said press and forming a wedge-shaped dewatering space between said endless upper and lower wires in said longitudinal direction of said twin-wire press for initial pressing and dewatering of said fiber suspension entering said wedge-shaped dewatering space, whereby a fiber web of said dewatered fiber suspension is formed between said endless upper and lower wires, a roll arrangement positioned subsequent to said first and second dewatering tables in said longitudinal direction for final pressing and dewatering of said fiber web between said endless and lower wires, a press frame, said roll arrangement being provided in said press frame, a press and lift arrangement for vertically adjusting one of said first and second dewatering tables, and a link system having a first end and a second end, said first end of said link system joined by a first joint to said press frame and said second end of said link system joint by a second joint to said one of said first and second dewatering tables, whereby said one of said first and second dewatering tables is movable along its entire longitudinal extension in the direction from and against said other of said first and second dewatering tables by means of said press and lift arrangement such that a rear edge of said one of said first and second dewatering tables is vertically adjusted a substantially equal distance as a front edge of said one of said first and second dewatering tables, whereby said one of said first and second dewatering tables is vertically adjusted along its entire longitudinal extension.

2. The twin-wire press according to claim 1, wherein said press and lift arrangement includes a first portion and a second portion, said first portion of said press and lift arrangement is fixed to said press frame and said second part of said press and lift arrangement is attached to said one of said first and second dewatering tables.

3. The twin-wire press according to claim 2, wherein said second part of said press and lift arrangement is attached to a position relative to said front edge of said one of said first and second dewatering tables.

4. The twin-wire press according to claim 2, wherein said first portion of said press and lift arrangement is connected to a projecting section of said press frame, in juxtaposition to an upper section of said one of said first and second dewatering tables predetermined distance from said wedge-shaped dewatering space.

5. The twin-wire press according to claim 1, wherein said press frame comprises a stop member arranged on a surface of said press frame in a space defined between said press frame and the front edge of said one of said first and second dewatering tables, opposite said one of said first and second dewatering tables.

6. The twin-wire press according to claim 1, wherein said press and lift arrangement comprises a hydraulic cylinder.

7. The twin-wire press according to claim 1, wherein said link system comprises a link arm including a first end and a second end, said first end of said link arm pivotally attached to said first joint at said one of said first and second dewatering tables, and said second end of said link arm pivotally attached to said second joint at said press frame.

8. The twin-wire press according to claim 1, wherein said twin-wire press comprises said link system and said press and lift arrangement on each side of said twin-wire press.

9. The twin-wire press according to claim 1, wherein said one of said first and second dewatering tables comprises an upper dewatering table and said other of said first and second dewatering tables comprises a lower dewatering table.

* * * * *

UNITED STATES PATENT AND TRADEMARK OFFICE

CERTIFICATE OF CORRECTION

PATENT NO. : 7,622,023 B2
APPLICATION NO. : 10/593198
DATED : November 24, 2009
INVENTOR(S) : Hans Lövgren It is certified that error appears in the above-identified patent and that said Letters Patent is hereby corrected as shown below:

Column 4, line 22, after “joints” delete “.”.
Column 6, line 5, after “tables” insert --a--.

Signed and Sealed this
Twenty-fifth Day of January, 2011

David J. Kappos
*Director of the United States Patent and Trademark Office*